US007163083B2

(12) United States Patent
Argoud

(10) Patent No.: US 7,163,083 B2
(45) Date of Patent: Jan. 16, 2007

(54) SAFETY ANCHORING DEVICE COMPRISING A SHOCK ABSORBER

(76) Inventor: Rodolphe Argoud, Le Mont, 38420 Revel (FR)

( * ) Notice: Subject to any disclaimer, the term of this patent is extended or adjusted under 35 U.S.C. 154(b) by 392 days.

(21) Appl. No.: 10/494,016

(22) PCT Filed: Oct. 10, 2002

(86) PCT No.: PCT/FR02/03454

§ 371 (c)(1),
(2), (4) Date: Jul. 1, 2004

(87) PCT Pub. No.: WO03/039680

PCT Pub. Date: Mar. 15, 2003

(65) Prior Publication Data

US 2004/0256176 A1 Dec. 23, 2004

(30) Foreign Application Priority Data

Nov. 5, 2001 (FR) ..... 01/14285

(51) Int. Cl.
*E04G 5/14* (2006.01)
*E04G 3/26* (2006.01)
*E04H 17/22* (2006.01)

(52) U.S. Cl. ..... 182/113; 182/45; 248/237; 256/DIG. 6

(58) Field of Classification Search ..... 182/3, 182/113, 36, 112, 45; 284/237; 256/DIG. 6, 256/59, 65, 67; 119/788, 786, 789
See application file for complete search history.

(56) References Cited

U.S. PATENT DOCUMENTS 3,798,856 A * 3/1974 Gloskowski ..... 52/127.2
5,011,106 A * 4/1991 Cody ..... 248/237
5,271,481 A * 12/1993 Rich ..... 182/3
5,307,897 A * 5/1994 Turner et al. ..... 182/3
5,346,036 A 9/1994 Arisman et al.
5,358,068 A * 10/1994 Whitmer ..... 182/113
5,398,777 A * 3/1995 Ouellette et al. ..... 182/3
5,458,214 A * 10/1995 Olson et al. ..... 182/18
5,588,272 A * 12/1996 Haponski ..... 52/125.4

(Continued)

FOREIGN PATENT DOCUMENTS

EP 0 075 055 A1 3/1983

(Continued)

*Primary Examiner*—Hugh B. Thompson, II
(74) *Attorney, Agent, or Firm*—Oliff & Berridge, PLC

(57) ABSTRACT

The invention relates to An anchoring device that is intended for, for example, the roof of a building. The inventive device comprises: a base which is used to fix to roofing; a hook element which is mounted to the base at one end thereof and which comprises a hook ring at the other end; a tilting mechanism which, in the event of an impact, enables the hook element to tilt in a normal plane in relation to the plane of extension of the base; a damping mechanism which is used to absorb energy during the tilting of the hook element. The damping mechanism comprises a trigger mechanism that can be used to prevent the hook element from tilting when the element is subjected to a force having an intensity that is lower than a pre-determined threshold. The aforementioned trigger mechanism comprises a removable part which is different from the other elements making up the damping mechanism.

8 Claims, 3 Drawing Sheets

U.S. PATENT DOCUMENTS

| | | | | |
|---|---|---|---|---|
| 5,718,305 | A * | 2/1998 | Palmer | 182/45 |
| 5,758,742 | A * | 6/1998 | Chiou et al. | 182/3 |
| 5,863,020 | A * | 1/1999 | Olson et al. | 182/3 |
| 6,216,414 | B1 * | 4/2001 | Feldberg | 52/736.1 |
| 6,412,230 | B1 * | 7/2002 | Zambelli et al. | 182/3 |
| 6,412,598 | B1 * | 7/2002 | Mackinnon | 182/3 |
| 6,478,111 | B1 * | 11/2002 | Olson et al. | 182/3 |
| 6,688,062 | B1 * | 2/2004 | Choate | 182/3 |
| 6,786,020 | B1 * | 9/2004 | Poldmaa | 182/45 |
| 6,868,647 | B1 * | 3/2005 | Poldmaa | 182/45 |

FOREIGN PATENT DOCUMENTS

| | | |
|---|---|---|
| GB | 2 351 789 A | 1/2001 |
| WO | WO 99/27213 | 6/1999 |

* cited by examiner

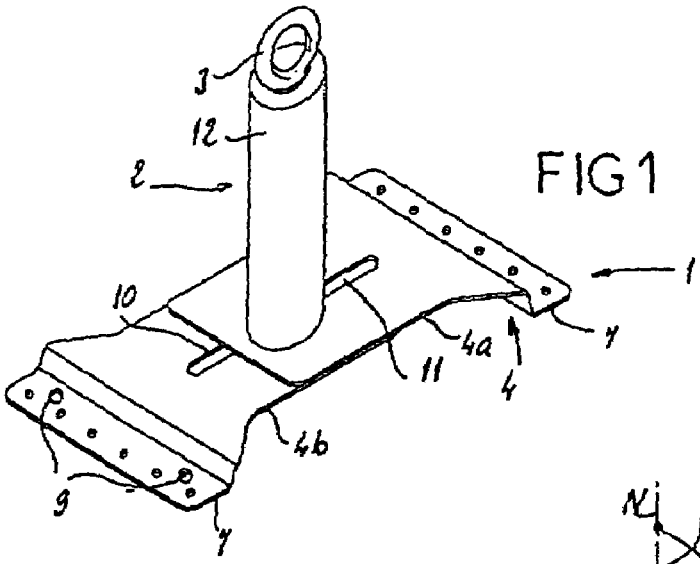
FIG 1
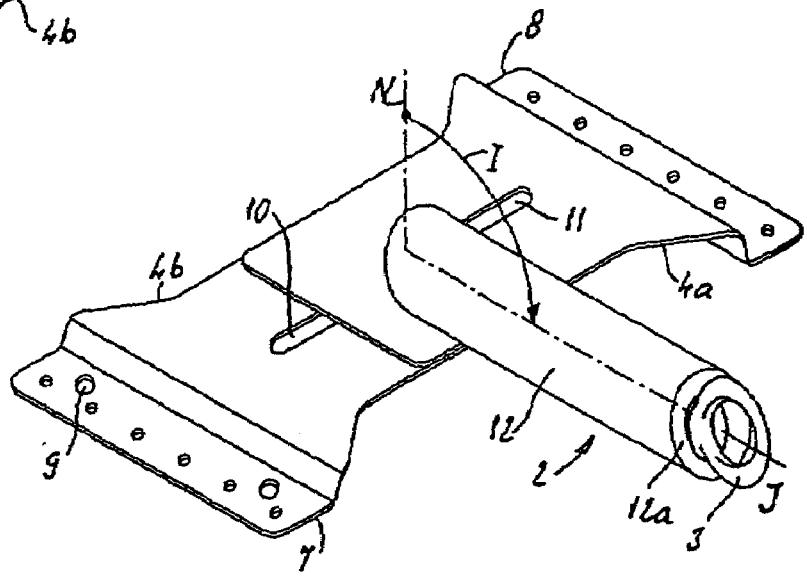
FIG 2
FIG 3
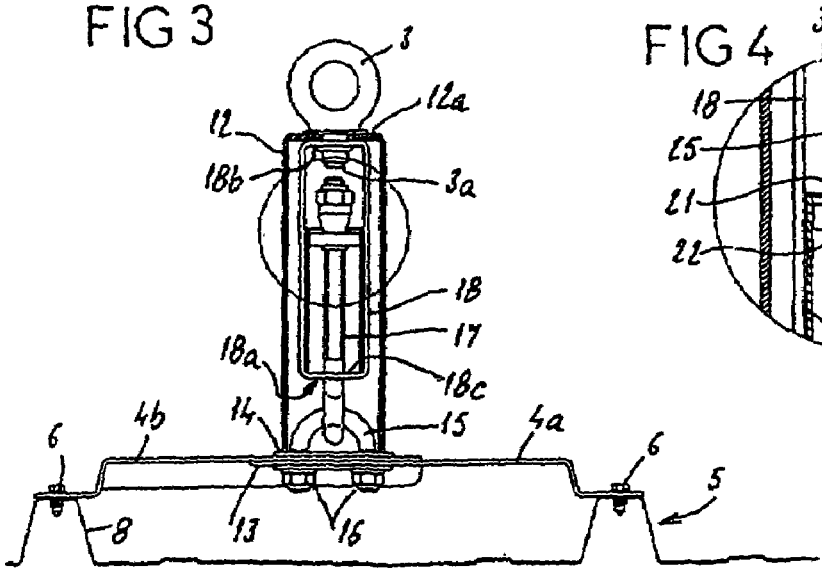
FIG 4
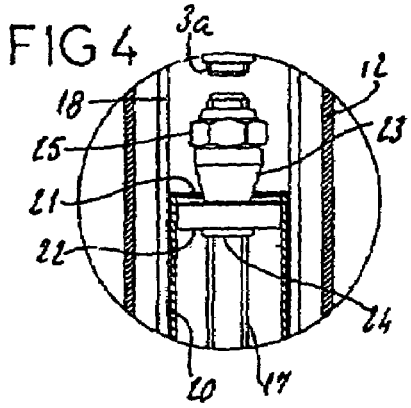

SAFETY ANCHORING DEVICE COMPRISING A SHOCK ABSORBER

BACKGROUND OF THE INVENTION

This application is a 371 of PCT/FR02/03454, filed Oct. 10, 2002

The present invention relates to the field of anchoring safety, for example for people working high up on roofs of buildings or on other structures.

To ensure the safety of individuals, in particular those working on roofs, the worker is provided with a harness and a tie that he connects to an anchoring device. In the event of a fall, it is this anchoring device, fastened to a receiving structure, for example the roof, which checks the fall.

Such an anchoring device must be able to limit the height of a person's fall as far as possible and induce a minimum amount of force on the receiving structure.

In certain cases, the receiving structure does not have sufficient strength to withstand large forces, such as during a fall, for example. It is therefore essential in those cases for the anchoring device to have an energy-absorbing capability, operating as it were as a shock absorber.

It is also necessary, when the anchoring device is being fastened to the receiving structure, for example a roof, to ensure that said roof is sealed. This problem arises in particular in the case of anchoring devices fastened directly to the framework and passing through the roof covering. The fact that the sealing function of the roof covering has to be restored after the anchoring device has been installed obviously adds significantly to the cost of the work undertaken.

Fastening anchoring devices directly to the roof covering presents not only problems of resistance to forces but also problems connected with variable forms of the roof coverings.

Known anchoring devices often have shock-absorbing means which need to be calibrated so that they can withstand a shock or a pull whose intensity is above a certain threshold.

Developing such anchoring devices is very difficult and requires a high number of tests for each intended use. It is thus necessary to ensure that the shock-absorbing means do not activate when subjected to a stress below a predetermined intensity on the one hand and that this adjustment does not negatively affect the level of absorption on the other hand.

It may be difficult to be able to reconcile the parameters and the tests do not generally allow verification to be carried out without irreversibly damaging the anchoring device.

The term "roof covering" is intended to mean any roof covering, and in particular corrugated steel sheeting, for example with a trapezoidal profile.

SUMMARY OF THE INVENTION

The aim of the present invention is to produce an anchoring device whose reliability may be verified without extra cost and which, where appropriate, may be reused with a minimum amount of repair either for additional tests or for fastening to a roof.

Another aim of the present invention is directed toward adjusting the dynamic behavior of the anchoring device to suit a specific use and/or specific constraints.

Another aim of the present invention is to produce an anchoring device whose reliability in terms of fastening or whose use is not compromised when the profile of the roof covering changes.

An additional aim of the present invention is directed toward providing anchoring safety in spite of a roof covering on which the anchoring device is fastened having a low resistance to forces.

According to the invention, the anchoring device intended to equip, for example, the roof of a building, comprises:

- a base combined with fastening means for fastening it to a roof covering,
- a hitching element mounted on the base and comprising a hitching ring at its end remote from the base,
- tilting means allowing the hitching element to tilt in the event of shock in a plane that is normal to the extension plane of the base,
- shock-absorbing means allowing energy to be absorbed during the tilting of the hitching element,
- said shock-absorbing means comprising a triggering means for preventing any tilting of the hitching element when the latter is subjected to a force whose intensity is below a predetermined threshold, said triggering means being a removable component separate from the other elements constituting the shock-absorbing means.

According to one exemplary embodiment of the anchoring device according to the invention, the shock-absorbing means comprise elements that slide with friction.

According to one exemplary embodiment, the triggering means is a deformable component whose resistance to deformation determines the predetermined triggering threshold.

According to one exemplary embodiment, the anchoring device comprises:

- a threaded rod articulated on the base with one of its ends, the other end extending inside a tubular body, passing through an opening made in a first end of the tubular body,
- a sleeve whose upper face has an opening through which a stub of the hitching ring passes, said stub likewise passing through the second end of said tubular body so as to grip said upper face of the sleeve, the lower end of said sleeve being open and bearing with its edge on the base,
- means for mounting the triggering means approximately at the end of the threaded rod extending inside the tubular body,
- and peripheral supports for the triggering means that are secured to the tubular body and oppose the movement of said triggering means in the event of the hitching ring being stressed.

According to one exemplary embodiment, the peripheral supports are produced with the edge of a friction tube inserted in the tubular body, said friction tube bearing with its opposite edge on the inner face of the first end of the tubular body.

According to one exemplary embodiment, the triggering means is a deformable washer.

According to one exemplary embodiment, the means for mounting the washer comprise a sliding guide, a conical component, an O-ring seal and a nut, which are mounted on the threaded rod.

According to one exemplary embodiment, the base comprises means for adjusting the spacing between the fastening means.

BRIEF DESCRIPTION OF THE DRAWINGS

Other features and advantages will also emerge from the detailed description given below, with reference to the appended drawings, by way of nonlimiting examples, in which drawings:

FIGS. 1 and 2 are schematic views of the anchoring device according to the invention in two different situations, FIG. 3 is a section of the anchoring device according to the invention, in the vertical position, FIG. 4 is an enlarged detail of FIG. 3.

DESCRIPTION OF THE PREFERRED EMBODIMENTS

Figure 5:
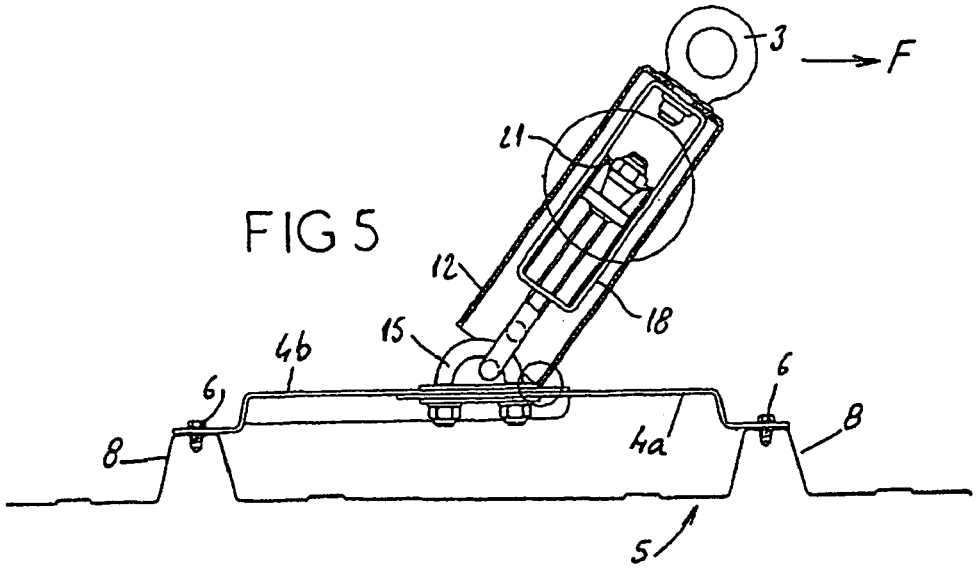
FIG. 5 is a section of the anchoring device subjected to a force F.

FIG. 1 shows an exemplary embodiment of an anchoring device 1 according to the invention.

The anchoring device 1 comprises a hitching element 2 surmounted by a hitching ring 3.

The anchoring device 1 also comprises a base 4 intended to be fastened to a roof covering 5. Means for mounting the hitching element 2 on the base 4 are also provided.

The base 4 is intended to be fastened to the roof covering 5 using fastening means 6 of the self-drilling screw type that respectively pass through a supporting end 7 of the base 4 in order to be screwed, for example, into a ridge 8 of the roof covering 5, as depicted in FIG. 3, for example. The base 4 is provided with drilled holes 9 for this purpose. These are made in the supporting end 7 of the base 4, for example.

The base 4 is made up of two partially superimposed parts 4*a*, 4*b* that are able to slide relative to one another for adjustment purposes. Each of the parts 4*a*, 4*b* is provided with an oblong hole 10, 11 made approximately in the central part and oriented so that the holes overlap one another over at least part of their length. Thus, when the parts 4*a*, 4*b* are adjusted by sliding, the oblong holes 10 and 11 remain at least partially superimposed.

The anchoring device 1 also comprises clamping means passing through the overlapping oblong holes 10 and 11, so as to allow the two parts 4*a*, 4*b* forming the base 4 to be secured with the hitching element 2.

This element comprises a sleeve 12 in which clamping means are at least partly integrated. These clamping means are formed by the means for mounting the hitching element 2 on the base 4.

The anchoring device 1 also comprises means enabling it to tilt the hitching element 2 in a plane that is normal to the extension plane of the base 4, specifically when said hitching element 2 is subjected to stress.

FIG. 2 thus depicts the hitching element 2 in a tilted position, for example following the application of stress or a strong pull on the hitching ring 3. The hitching element 2 is thus tilted through an angle I so that the orientation of its longitudinal axis J approaches as far as possible an axis contained in the extension plane of the base 4. A strong pull on the hitching ring 3 in the tilted position (FIG. 2) will thus lead to shear forces on the fastening means 6 for the base 4. The pulling or wrenching forces will thus be substantially reduced. This is perfectly compatible with a roof covering 5 of lesser strength, which may have a relatively small thickness.

The anchoring device 1 comprises, for example, energy-absorbing or shock-absorbing means that are activated when the hitching element 2 tilts relative to the base 4. These energy-absorbing means are integrated into the sleeve 12, for example.

The base 4 comprises means for adjusting the spacing between the fastening means 6. The adjustment means are produced with the base 4 in two parts 4*a*, 4*b* that are able to slide relative to one another, with the oblong holes 10 and 11 that overlap one another over at least part of their length, and with clamping means. These clamping means comprise clamping plates 13 and 14 intended to grip the superimposed base parts 4*a*, 4*b*.

A connecting piece 15 of the yoke type approximately in the shape of an inverted U thus passes through the clamping plate 14, the oblong holes 10 and 11 and the clamping plate 13, respectively, and is provided with a locknut 16 on each of its branches 15*a*. The locknuts 16 are thus situated under the base 4.

The anchoring device 1 also comprises a threaded rod 17 articulated on the base 4 with one of its ends, more precisely on the connecting piece 15, the other end extending inside a tubular body 18. For this purpose, the threaded rod 17 passes through an opening made in a first end 18*a* of said tubular body 18.

The upper end 12*a* of the sleeve 12 has an opening through which a stub 3*a* of the hitching ring 3 passes. This stub also passes through the second end 18*b* of the tubular body 18 so as to grip said upper end 12*a* of the sleeve 12. The lower end of the sleeve 12 is open and bears, with its edge, on the base 4 and, more precisely, on the clamping plate 14.

According to the invention, the shock-absorbing means are integrated in the sleeve 12, for example. The shock-absorbing means comprise a triggering means for preventing any tilting of the hitching element 2 when the latter is subjected to a force whose intensity is below a predetermined threshold. The triggering means is a removable component and separate from the other elements constituting the shock-absorbing means. This component may thus be replaced independently of the other elements constituting the shock-absorbing means or the anchoring device 1.

To this end, the anchoring device 1 comprises means for mounting the triggering means approximately at the end of the threaded rod 17 extending inside the tubular body 18. The latter advantageously has peripheral supports for the triggering means that are secured to said tubular body 18 and oppose the movement of said triggering means in the event of the hitching ring 3 being stressed.

The triggering means is preferably a component whose resistance to deformation determines the predetermined triggering threshold and therefore the start of the shock absorption. The peripheral supports in the tubular body 18 are produced with an edge 19 of a friction tube 20 inserted in the tubular body 18. The friction tube 20 bears with its opposite edge on the inner face 18*c* of the first end 18*a* of the tubular body 18.

The triggering means is produced by a deformable washer 21. To this end, the anchoring device 1 comprises means for mounting the deformable washer 21 that comprise a sliding guide 22, a conical component 23, an O-ring seal 24 and a retaining nut 25, all mounted on the threaded rod 17 as shown in FIG. 4.

The sliding guide 22 is intended to center the threaded rod 17 in the friction tube 20 during the tilting of the hitching element 2, leading to the deformed washer 21 sliding with friction in said friction tube 20.

The sliding guide 22 is kept in position by virtue of the O-ring seal 24 and the conical component 23, which component also immobilizes the washer 21 on the upper edge of the friction tube 20, the whole also being in position by virtue of the tightening of the nut 25 at the end of the threaded rod 17. The sliding with friction of the deformed washer 21 in the friction tube 20 makes it possible to absorb energy during the tilting of the hitching element 2. The shock-absorbing means comprise elements that slide with friction and the washer 21 makes it possible to produce a triggering means for preventing any tilting of the hitching element 2 when the latter is not sufficiently stressed.

Figure 6:
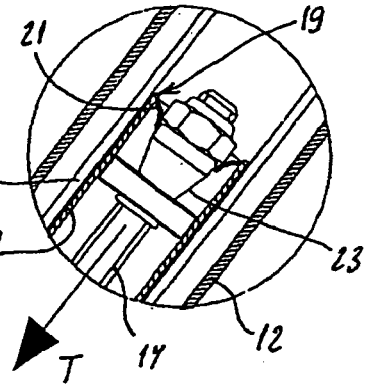
FIG. 6 is an enlarged detail of FIG. 5.

A stressing force on the hitching ring 3 is illustrated by the arrow F in FIG. 5. A sufficient intensity of such a force F, corresponding for example to a person falling from a roof, leads to deformation of the washer 21 and uniform peripheral friction in the friction tube 20. The relative tension exerted between the friction tube 20 and the threaded rod 17 is represented by the arrow T in FIG. 6. The conical component 23 thus drives the washer 21 into the friction tube 20 as soon as the tension T has reached an intensity above that corresponding to the deformation threshold for said washer 21.

During the tilting of the hitching element 2, it is the sleeve 12 that bears on the base 4 and causes the deformed washer 21 to slide in the friction tube. The relative tensile force between the friction tube 20 secured to the tubular body 18 and the threaded rod 17 thus makes it possible to absorb the fall of a person during the tilting of said hitching element 2.

Figure 7:
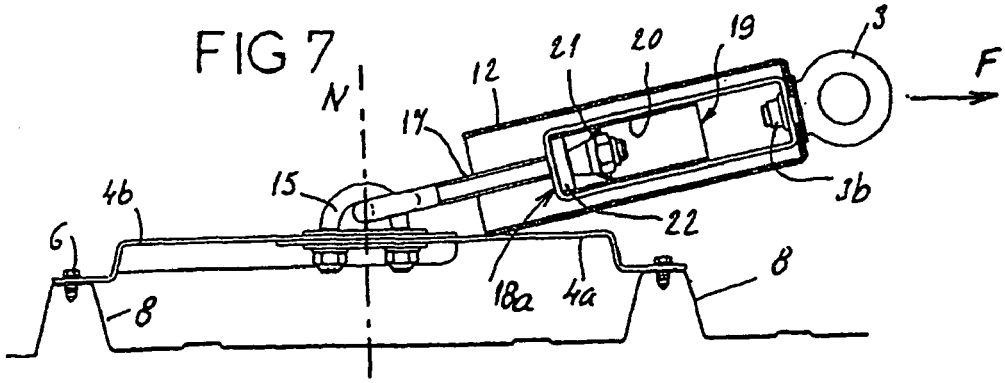
FIG. 7 is a section of the anchoring device according to the invention, in the tilted position.

The travel of the deformable washer 21 in the friction tube 20 is limited by the sliding guide 22 arriving at and butting against the inner face 18*c* of the first end 18*a* of the tubular body 18. This end of travel also corresponds to a longitudinal axis J of the hitching element 2, inclined as far as possible and approaching an inclination of 90° relative to a normal N of the extension plane of the base 4. The force F thus symbolizes the weight of a person who has suffered a fall, as is depicted in FIG. 7. The force F is thus transmitted to the fastening means 6 mainly in the form of shear force. The risk of wrenching to which the fastening means 6 fitted into ridges 8, for example self-drilling screws, are exposed is therefore significantly reduced.

The clamping means of the hitching element 2 are obtained with the stub 3*a* being screwed into a clamping nut 3*b* with the rotation of the hitching ring 3 and thus gripping the second end 18*b* of the tubular body 18 and the upper face 12*a* of the sleeve 12. The dimensions of the sleeve 12 and of the tubular body 18 are selected so as to obtain optimum clamping of the washer 21 on the edge 19 of the friction tube 20 when the hitching element 2 is in the vertical position. Clamping is obtained by the rotation of the hitching ring 3, the articulation of the threaded rod 17 on the base 4 and the bearing of the sleeve 12 on said base 4.

As a variant, the nut 3*b* may be replaced by a tapped hole in the upper face 12*a* of the sleeve 12.

Figure 8:
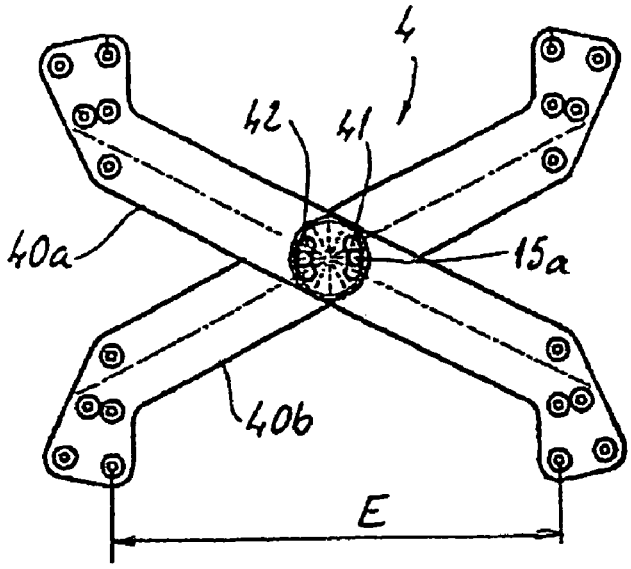
FIGS. 8 and 9 show another exemplary embodiment of the base of the device according to the invention.
Figure 9:
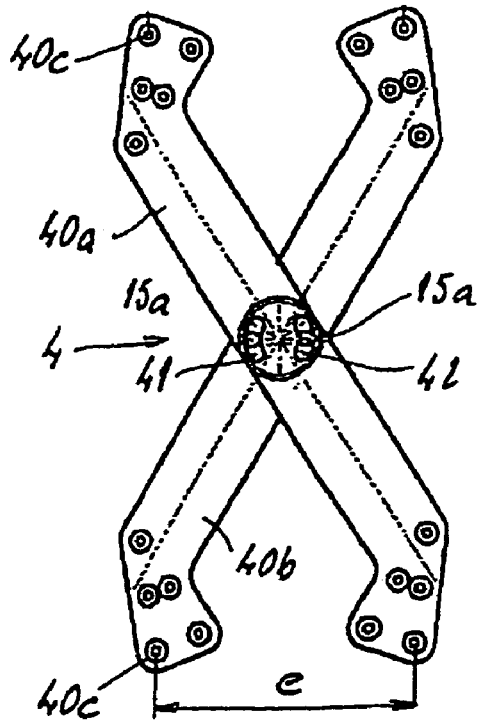

In the exemplary embodiment depicted in FIGS. 8 and 9, the base 4 comprises two arms 40*a*, 40*b* that are superimposed in their central part. Drilled holes 40*c* provided at each end of the arms 40*a*, 40*b* are intended to have self-drilling screws passing through them, for example.

The arms 40*a*, 40*b* are able to pivot relative to one another for adjustment purposes.

To this end, oblong slots 41, 42 are made in each arm 40*a*, 40*b*, approximately in the central position. The oblong slots 41, 42 in the arm 40*a* thus at least partially overlap the oblong slots in the other arm 40*b*. The extent of such an overlap depends on the relative pivoting of the two arms 40*a*, 40*b*.

The clamping means, comprising for example the yoke 15, pass through the superimposed oblong slots 41, 42 in the two arms 40*a*, 40*b* and thus allow the two arms 40*a*, 40*b* forming the base 4 to be secured with the hitching element 2.

Before clamping, it is also possible, by way of the relative pivoting of the two arms 40*a*, 40*b*, to modify the spacing between the drilled holes 40*c*, and therefore between the fastening means.

It is possible, for example, to pass from a maximum spacing E illustrated in FIG. 8 to a minimum spacing e illustrated in FIG. 9.

The base 4 may then be tailored to roof coverings having different spacings between the ridges 8.

One advantage of the anchoring device 1 according to the invention is the possibility of tilting it in any plane normal to the extension plane of the base 4.

Another advantage lies in the ability to tailor the anchoring device 1 to various spacings between the ridges 8.

Another advantage lies in the removability of the washer 21. This washer may thus be replaced at very little cost. Such a replacement would make it possible to modify the triggering threshold of the shock-absorbing means.

Tests that can be reproduced easily are thus obtained, which is not the case with the plastic deformation of a component. Friction, and therefore shock absorption, may be controlled more reliably within the framework of the invention.

The invention claimed is:

1. Anchoring device for attaching to a roof of a building, comprising:

a base combined with fastening means for fastening the base to a roof covering, a hitching element mounted on the base and comprising a hitching ring at its end remote from the base, tilting means allowing the hitching element to tilt in the event of shock in a plane that is normal to an extension plane of the base, shock-absorbing means allowing energy to be absorbed during the tilting of the hitching element, said shock-absorbing means comprising a triggering means for preventing any tilting of the hitching element when the latter is subjected to a force whose intensity is below a predetermined threshold, said triggering means being a removable component separate from other elements constituting the shock-absorbing means.

2. Anchoring device according to claim 1, characterized in that the shock-absorbing means comprise elements that slide with friction.

3. Anchoring device according to claim 1, characterized in that the triggering means is a deformable component whose resistance to deformation determines the predetermined triggering threshold.

4. Anchoring device according to claim 1, characterized in that it further comprises:

a threaded rod articulated on the base at one of its ends, the other end extending inside a tubular body, passing through an opening made in a first end of the tubular body, a sleeve whose upper face has an opening through which a stub of the hitching ring passes, said stub likewise passing through the other end of said tubular body so as to grip said upper face of the sleeve, a lower end of said sleeve being open and bearing with its edge on the base, means for mounting the triggering means approximately at the other end of the threaded rod extending inside the tubular body, and peripheral supports for the triggering means that are secured to the tubular body and oppose movement of said triggering means in the event of the hitching ring being stressed.

5. Anchoring device according to claim 4, characterized in that the peripheral supports are produced with an edge of a friction tube inserted in the tubular body, said friction tube bearing with its opposite edge on an inner face of the first end of the tubular body.

6. Anchoring device according to claim 4, characterized in that the triggering means is a deformable washer.

7. Anchoring device according to claim 6, characterized in that the means for mounting the triggering means comprise a sliding guide, a conical component, an O-ring seal and a nut, which are mounted on the threaded rod (17).

8. Anchoring device according to claim 1, characterized in that the base comprises means for adjusting the spacing between the fastening means.

* * * * *